US005381136A

United States Patent [19]

Powers et al.

[11] Patent Number: 5,381,136

[45] Date of Patent: Jan. 10, 1995

[54] REMOTE DATA COLLECTION AND MONITORING SYSTEM FOR DISTRIBUTION LINE

[75] Inventors: Robert D. Powers, Shorewood; Harold L. Ryterski, Naperville, both of Ill.

[73] Assignee: Northern Illinois Gas Company, Aurora, Ill.

[21] Appl. No.: 34,504

[22] Filed: Mar. 19, 1993

[51] Int. Cl.[6] ..... G08B 1/08

[52] U.S. Cl. ..... 340/539; 340/531

[58] Field of Search ..... 340/539, 531, 517, 518

[56] References Cited

U.S. PATENT DOCUMENTS

| | | | |
|---|---|---|---|
| 4,153,881 | 5/1979 | Permut et al. | 340/539 |
| 4,387,368 | 6/1983 | Day, III et al. | 340/517 |
| 4,673,920 | 6/1987 | Ferguson et al. | 340/531 |
| 4,812,820 | 3/1989 | Chatwin | 340/531 |
| 5,132,968 | 7/1992 | Cephus | 340/539 |

*Primary Examiner*—Donnie L. Crosland
*Attorney, Agent, or Firm*—Emrich & Dithmar

[57] ABSTRACT

A remote logger unit monitors various operating parameters of a distribution line, or transmission system, such as pressure, temperature and flow such as for natural gas, water or oil, and alerts a central controller via an RF link when predetermined operating limits as determined by the logger unit are exceeded. A plurality of such remote logger units may be employed along the length of the distribution line for monitoring the complete system, with the reports of more distant logger units routed to the central controller via closer logger units. Each logger unit is passive in operation, autonomous and entirely independent of the central controller, and also provides routine operation data to the central controller when prompted, or at designated time intervals. The reported data includes the identity of the logger unit, the nature of the data or alert, and the time and date of the report.

13 Claims, 7 Drawing Sheets

REMOTE DATA COLLECTION AND MONITORING SYSTEM FOR DISTRIBUTION LINE

FIELD OF THE INVENTION

This invention relates generally to a data collection and monitoring system and is particularly directed to a remote data collection and monitoring system including a plurality of passive autonomous logger units connected via an RF link to a central controller for reporting routine operating data as well as alerting the central controller when operating parameters exceed normal operation limits.

BACKGROUND OF THE INVENTION

Commodities such as gas, water, oil and electricity are typically delivered by large transmission systems covering an extensive area. The transmission system typically includes a large array of distribution lines and various remotely located monitoring and control stations linked to a central controller by a suitable communications link. The communications link may be either in the form of a wired system or via radio frequency (RF) transmissions. The communications link is typically bi-directional allowing the remotely located stations to provide system status reports to the central controller and the central controller to direct the remotely located stations by appropriate commands.

The central controller generally prompts each remotely located station either at designated time intervals or randomly for information relating to the status of the transmission system at that location. The central controller is under computer control and typically requires a rather sophisticated arrangement of hardware and software to monitor and control a potentially large number of remotely located stations. Such systems are costly to purchase, maintain and expand upon. Moreover, the central controller is typically informed of the existence of an alarm condition and not the specific nature of the alarm. AC power must typically be provided to each remote station and easements must therefore be obtained to supply power to each remote station as well as to connect the remote stations to the central controller by wire. When RF links are used between the remote stations and the central controller, a Federal Communications Commission (FCC) license is typically required with its associated annual fees because of the high frequency of use of the communications link. Finally, when information is provided by wire between the central controller and the remote stations, each remote station must be connected to the central controller via its own discrete, dedicated signal conducting lead. This further increases the complexity and expense of the centrally controlled monitoring and control system.

The present invention addresses the aforementioned limitations of the prior art by providing a remote data collection and monitoring system for a transmission system, or distribution line, which employs a plurality of independent, computer controlled, remote logger units for monitoring the system or line and for reporting via an RF link operating characteristics, including alarms, to a central controller.

OBJECTS AND SUMMARY OF THE INVENTION

Accordingly, it is an object of the present invention to provide for the passive monitoring of an extensive transmission system, or distribution line, by means of a plurality of remotely located, autonomous logger units.

It is another object of the present invention to connect a plurality of remotely located logger units via an RF link to allow for monitoring and control of a transmission system such as for natural gas, water, electricity or oil.

The present invention contemplates a remote data collection and monitoring system for a transmission system, or distribution line, including field hardware in the form of a plurality of independent, stand-alone, remote logger units which monitor and record system operating parameters and report these parameters to a central controller via an RF link. Each remote logger unit is computer controlled and stores system parameter readings together with the date and time of the reading for reporting to the central controller. Each remote logger unit is programmed to monitor a given number of sensors, to ask for data from each of the plurality of sensors at selected times, and to wait for a response after asking for data from a particular sensor for a predetermined time period before reporting to the central controller.

Each remote logger unit is capable of storing data for several days or more and is programmed with parameter limits defining alarm states for reporting to the central controller via the RF link. Receipt by a remote logger unit from one of its associated sensors of an input signal outside of prescribed limits, as determined by the logger unit, corresponding to an alarm state or receipt of no response causes the remote logger unit to store that reading, close its open files, and perform a connect request to the central controller. At this time, if all other system operating criteria have been met, the central controller accepts the connection to the remote logger unit and reads all of the data currently in the remote logger unit together with the alarm information. When all data and alarm information has been received by the central controller, the remote logger unit is directed by the central controller to return to logging readings and is disconnected from the central controller. At this time, the central controller provides the received data and alarm information to a display device such as a printer or cathode ray tube (CRT) for use by a system operator.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
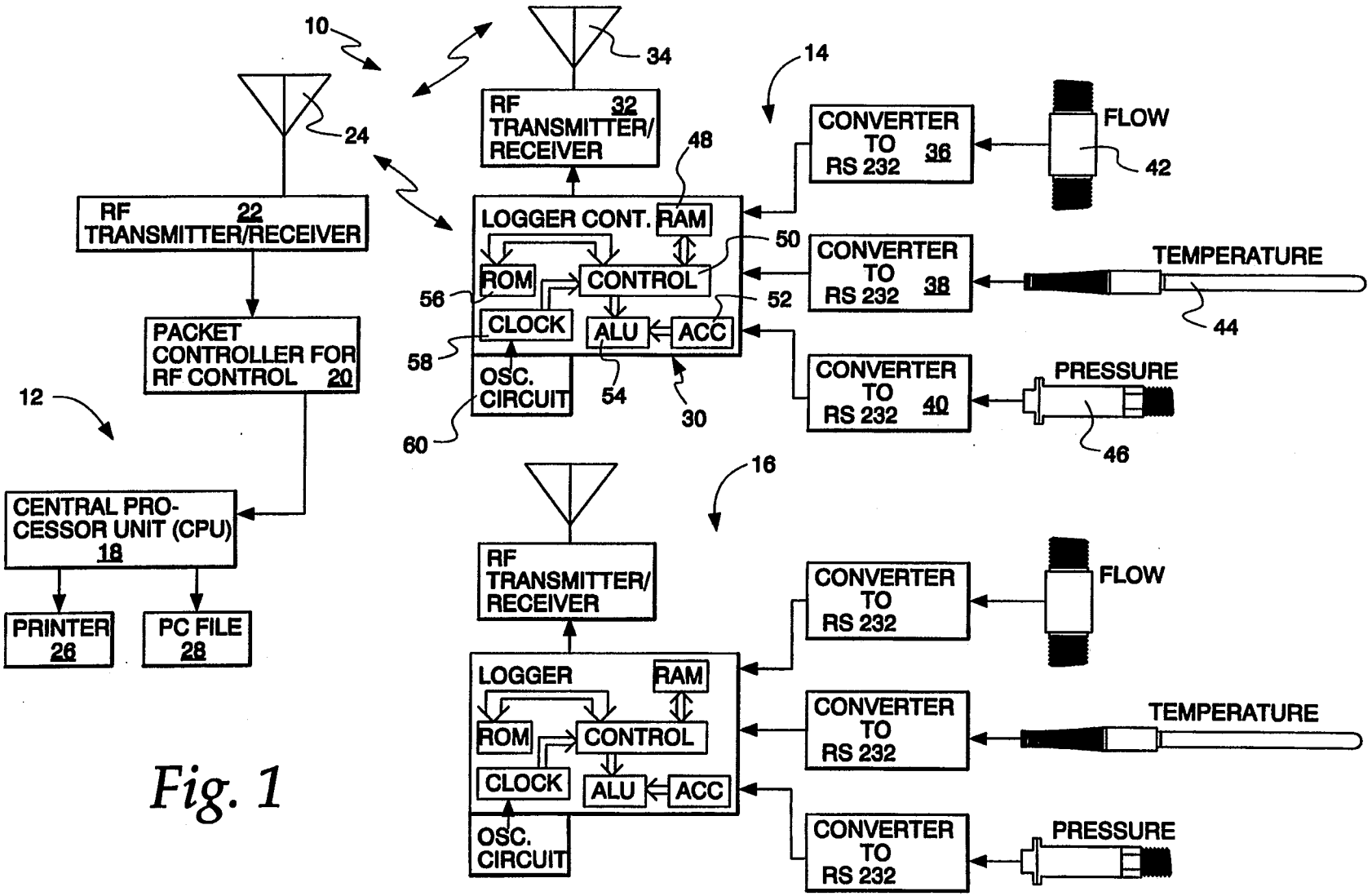
FIG. 1 is a simplified combined schematic and block diagram of a remote data collection and monitoring system for use in a distribution line in accordance with the present invention.

Referring to FIG. 1, there is shown a combined block and schematic diagram of a remote data collection/monitoring system 10 in accordance with the principles of the present invention. Data collection/monitoring system 10 includes a central, or master, controller 12 and a plurality of remotely located logger units, where only first and second remote logger units 14 and 16 are shown in the figure for simplicity. Central controller 12 communicates with the first and second remote logger units 14, 16 by means of an RF link, and an RF link is similarly used to provide information from one remote logger unit to another as described in detail below.

Central controller 12 includes a central processor unit (CPU) 18 for controlling the overall operation of the remote data collection/monitoring system 10. CPU 18 may include such components as a random access memory (RAM) for temporarily storing programs and data, a disc controller, a floppy disc system for permanently storing programs and data, an interface for communicating with a printer 26 and a PC data file 28, and a bus structure to which the CPU, RAM, disc controller and interface are connected. The specific details of CPU 18 are not shown in the figure for simplicity and because the CPU may assume various hardware and firmware configurations for carrying out the present invention.

Central controller 12 further includes a packet controller 20 coupled to CPU 18 for exercising RF transmission and reception control. Packet controller 20 is coupled to an RF transmitter/receiver 22 which, in turn, is coupled to an antenna 24. Central controller 12 is thus adapted for receiving system operating data and alert indications from the first and second remote logger units 14, 16, storing these inputs in the PC file 28 and displaying this information in various forms such as on a printer 26 for use by a system operator, and transmitting commands to each of a plurality of such remote logger units in exercising control over the data collection/monitoring system 10. The manner in which information is received by the central controller 12 from the remote logger units 14 and 16 and the commands output by the central controller to the remote logger units is determined by an operating program stored in the central controller's CPU 18. Portions of the details of this operating program which relate to the present invention are described in detail below.

Each of the first and second remote logger units 14, 16 has generally the same organization, structure and function. However, the present invention is not limited to a plurality of remote logger units having the same operating characteristics and configuration, as variations among the various remote logger units may arise depending upon the specific functions required. However, for simplicity, the first and second remote logger units 14, 16 are shown as identical in configuration and operation and therefore only the first remote logger unit 14 is described herein in detail. Finally, while only two remote logger units are shown in the data collection/monitoring system 10 of FIG. 1, the present invention is not limited to this number and may include virtually any number of remote logger units, each reporting operating parameters and alarm conditions at its associated remote location to the central controller 12.

Remote logger unit 14 includes the combination of an RF transmitter/receiver 32 and an antenna 34 for transmitting operating data and alarm indications to the central controller 12 and for receiving control and command inputs from the central controller. Remote logger unit 14 further includes a logger controller 30 coupled to the RF transmitter/receiver 32 as well as to a plurality of RS-232 converters 36, 38 and 40. Each of the RS-232 converters 36, 38 and 40 is, in turn, respectfully coupled to a flow sensor 42, a temperature sensor 44, and a pressure sensor 46. The flow, temperature and pressure sensors 42, 44 and 46 provide system operating data and status information at a remote site in the distribution line to RS-232 converters 36, 38 and 40, respectively. The present invention is described herein as employed in a natural gas distribution line, it being understood that this invention is not limited to the use of the three types of sensors shown in FIG. 1 in this type of distribution or transmission system. Virtually any type of sensor, or combination of sensors, may be used in each remote logger unit employed in the data collection/monitoring system 10 of the present invention.

Data converters 36, 38 and 40 provide the sensed data in RS-232 format to the logger controller 30. Logger controller 30 is a conventional microcomputer programmed to carry out operations in accordance with the present invention as described in detail below. Logger controller 30 may be conventional in design, with the Zilog 12 MHz microcomputer utilized in the preferred embodiment of the present invention. Logger controller 30 includes a controller 50, a clock 58, an arithmetic and logic unit (ALU) 54, an accumulator 52, a read only memory (ROM) 56 and a random access memory (RAM) 48. Logger controller 30 stores instructions and data, periodically updates the stored data, compares both stored and real-time data and makes decisions based upon these comparisons by means of logic instructions stored in its ROM 56 in monitoring operating parameters of a distribution line at the locations of the remote logger units. ROM 56 is a programmable, non-volatile, factory produced memory matrix which includes a plurality of memory locations or "bytes".

An external crystal oscillator circuit 60 provides timing signals to clock 58 of the logger controller 30 for controlling the timing of operations carried out by the logger controller. Controller 50 is responsive to instructions read from ROM 56 and directs ALU 54 to perform various arithmetic operations in accordance with these instructions with respect to data stored in RAM 48 and to real-time data provided to the logger controller 30 from the various remote sensors as well as with respect to commands received from the central controller 12.

Data from the various remotely located sensors is provided via the logger controller's accumulator 52 to ALU 54 and, based upon comparison of these various real-time inputs to the logger controller 30 with data read from RAM 48, the logger controller performs various functions and generates various output signals for RF transmission to the central controller 12 as described below.

Figure 2:
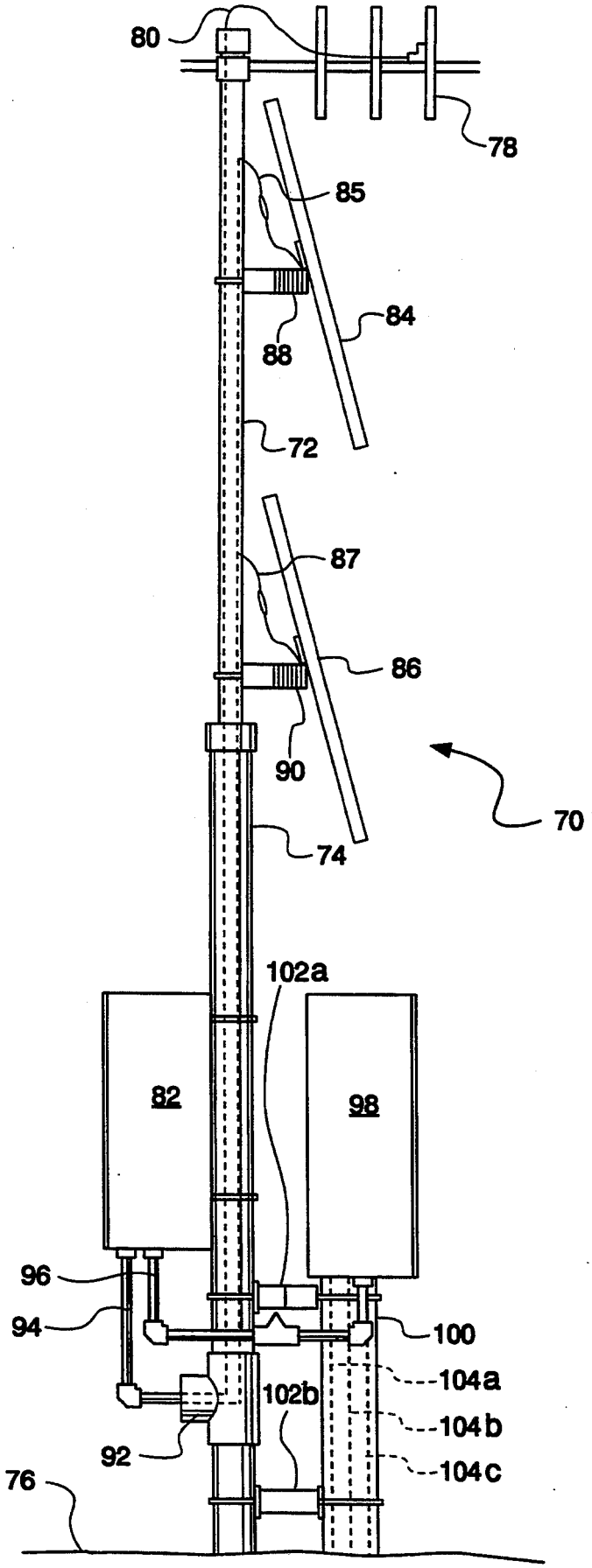
FIG. 2 is a simplified schematic diagram of a remote logger unit for use in the data collection and monitoring system of FIG. 1.

Referring to FIG. 2, there is shown a simplified schematic diagram of a remote logger unit 70 used in the present invention. Remote logger unit 70 includes an upper conduit 72 positioned upon and supported by a lower conduit 74. Lower conduit 74 is securely positioned within a support structure 76 which may be either soil or a concrete footing. Mounted to an upper end of the upper conduit 72 is an RF antenna 78. Also attached to the upper conduit 72 by means of first and second mounting brackets 88 and 90 are first and second solar panels 84 and 86, respectively. Antenna 78 is coupled by means of a lead 80 to circuitry described below which is disposed in a first electrical cabinet 82. Similarly, the first and second solar panels 84, 86 are coupled to circuitry within the first electrical cabinet 82 by respective electrical leads 85 and 87. Solar panels 84, 86 power the remote logger unit 70 and eliminate the requirement to hard wire the logger unit to a power source such as an electrical utility. As shown in the figure, the leads from antenna 78 and first and second solar panels 84, 86 extend down through the upper and lower conduits 72, 74 and through the combination of a T coupler 92 and a first electrical conduit 94 to the first electrical cabinet 82. The contents of the first electrical cabinet 82 are described in detail below.

The remote logger unit 70 further includes a second electrical cabinet 98, the contents of which are also described in detail below. Second electrical cabinet 98 is coupled to the distribution line (not shown in the figure for simplicity) by means of an electrical conduit 100. Extending down to the distribution line and disposed within electrical conduit 100 are first, second and third electrical leads **104*a*, 104*b* and 104*c* which are each connected to a respective sensor (also not shown for simplicity) in the distribution line. In this manner, signals representing various operating parameters of the distribution line are provided to the second electrical cabinet 98. As shown in the figure, electrical conduit 100 extends into the support structure 76, which may be soil, for monitoring the operation of an underground distribution line. However, the present invention is not limited to use with underground distribution lines or transmission systems and may be used equally as well with overhead distribution lines or transmission systems. Lower conduit 74 and electrical conduit 100 are coupled together by means of a plurality of coupling brackets 102*a* and 102*b* for increased support and stability for the remote logger unit 70. The first and second electrical cabinets 82 and 98 are coupled by means of a second electrical conduit 96 which carries various electrical leads between the two cabinets as described below. Remote logger unit 70 is designed to operate independent of the central controller 12** in remote locations and to be essentially self-supporting and autonomous.

Figure 3:
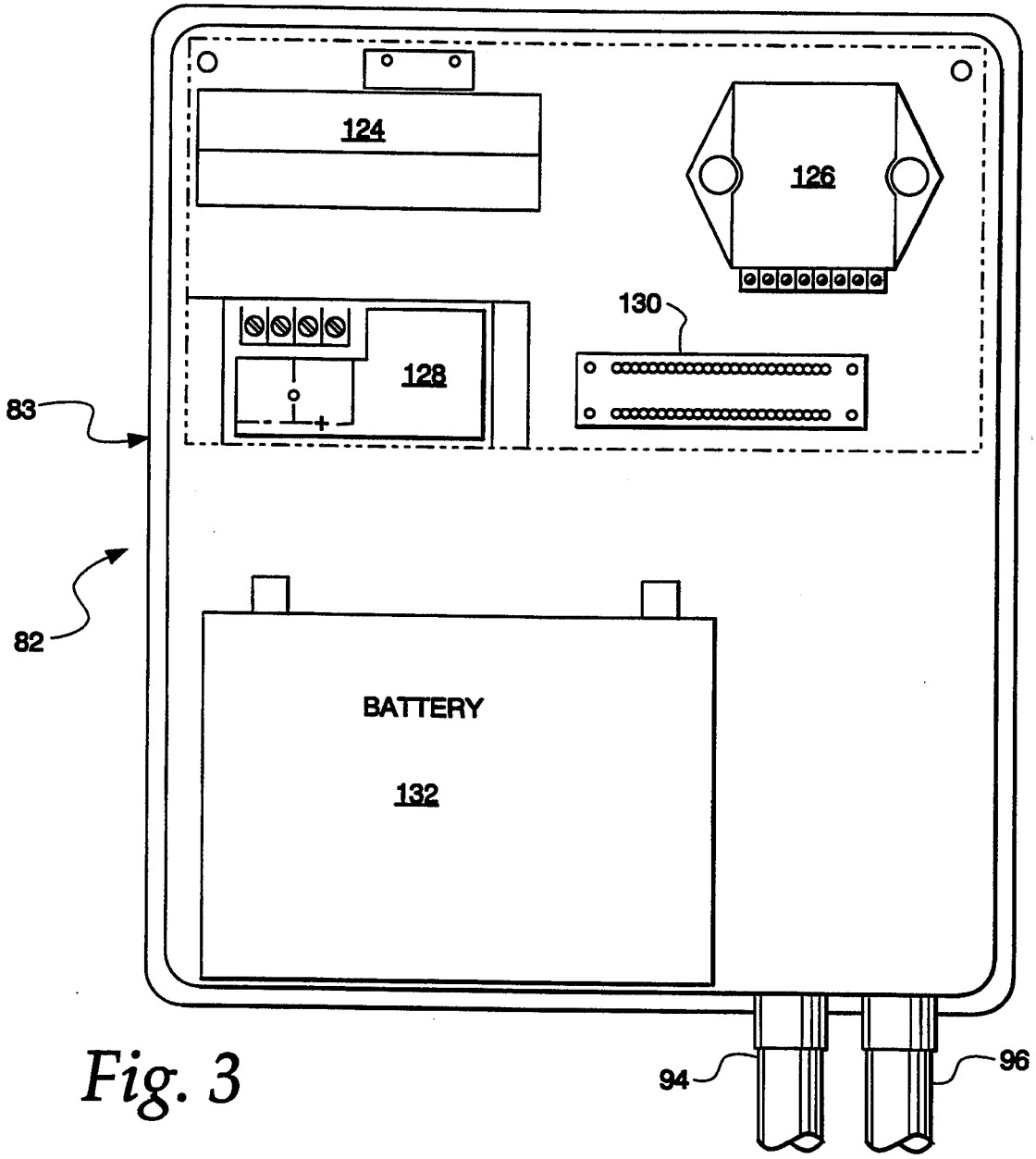
FIG. 3 is a simplified schematic diagram of an electrical cabinet layout for use in the remote logger unit of FIG. 2.

Referring to FIG. 3, there is shown a simplified schematic diagram of the first electrical cabinet 82 and its contents. The first electrical cabinet 82 includes a housing 83 comprised of sheet metal and including an access door which is not shown for simplicity. Extending from a lower portion of the cabinet housing 83 are previously described first and second electrical conduits 94 and 96. Disposed within the first electrical cabinet 82 is a UHF transmitter/receiver with controller 124 which operates at 2–5 watts. Also in the first electrical cabinet 82 is a data processing module 126 which includes the remote logger unit's controller and data converters described above. The first electrical cabinet 82 further includes a charge controller 128 for the solar system which operates in conjunction with a battery 132 and the above-described first and second solar panels 84, 86. Battery 132 is preferably a 33 amp-hour, 12V gel-cell type battery. Also disposed within the first electrical cabinet 82 is a power bus 130 for distributing power from battery 132 to the various aforementioned components within the electrical cabinet. The first electrical cabinet 82 thus contains the remote logger unit's power, control and communications circuitry.

Figure 4:
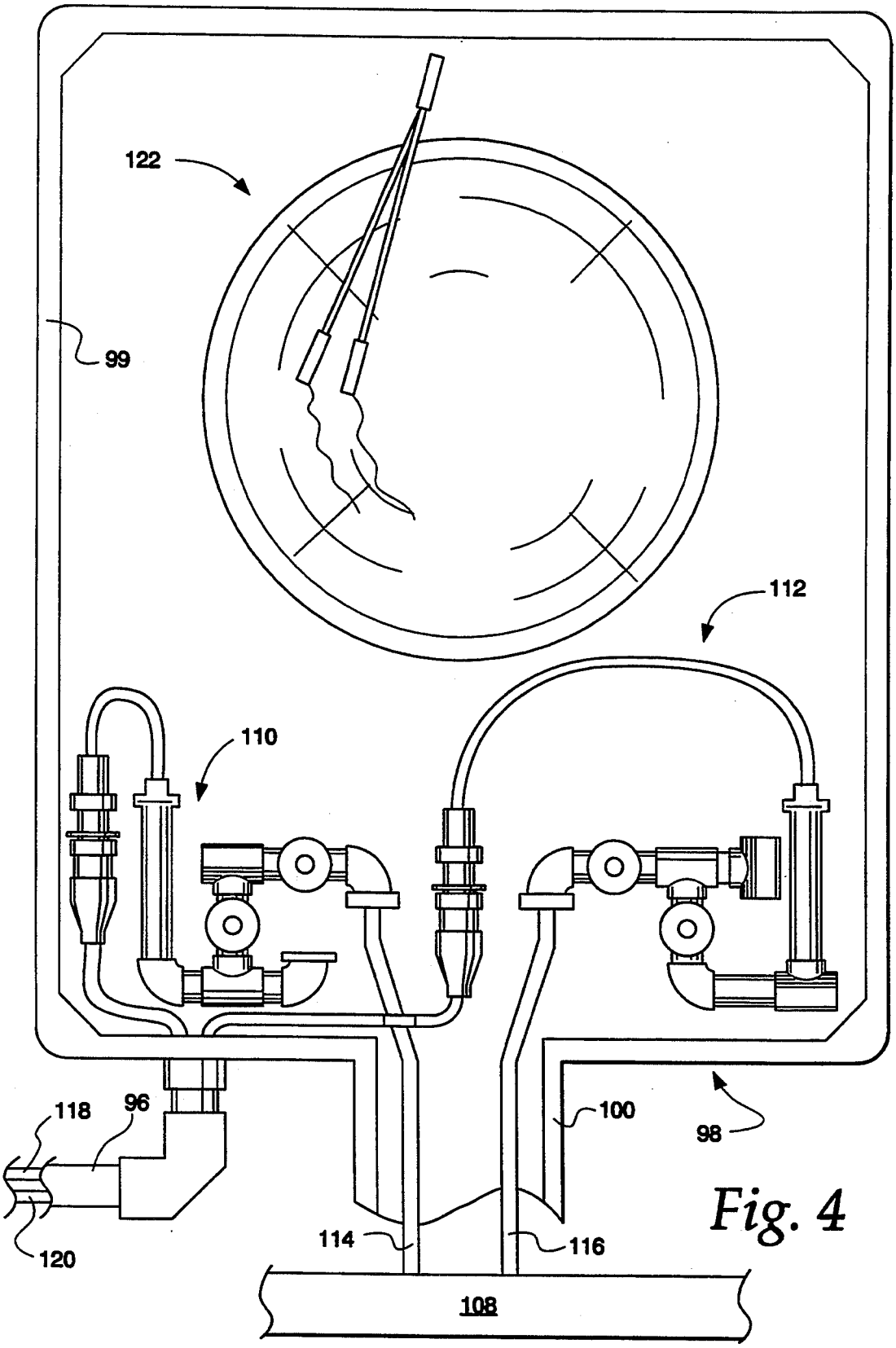
FIG. 4 is a simplified schematic diagram of a chart recorder and sensor cabinet for use in the remote logger unit of FIG. 2.

Referring to FIG. 4, there is shown a simplified schematic diagram of the contents of the second electrical cabinet 98 in the remote logger unit. As in the case of the first electrical cabinet 82, the second electrical cabinet 98 is also preferably comprised of a high strength sheet metal housing 99 and includes an access door (not shown in the figure for simplicity). Various sensors and recorders are disposed within the second electrical cabinet 98, with the sensors connected to the distribution line 108 for monitoring distribution line operating parameters and also connected to the first electrical cabinet 82 for processing and transmission of the operating data and alarm signals. Shown in the second electrical cabinet 98 is a representative example of a sensor and recording arrangement for use in a remote logger unit, it being understood that various sensor and recording arrangements may be incorporated in the electrical cabinet.

Disposed within the second electrical cabinet 98 are first and second pressure sensors 110 and 112. The first pressure sensor 110 is coupled to the distribution line 108 by means of a first pressure line 114. Similarly, the second pressure sensor 112 is coupled to the distribution line 108 by means of a second pressure line 116. The first pressure sensor 110 is adapted for measuring a high pressure, while the second pressure sensor 112 is adapted for measuring a low pressure. In this manner, the first and second pressure sensors 110, 112 may be used to measure high and low pressures within the distribution line 108. The first and second pressure sensors 110, 112 are respectively coupled to the first electrical cabinet 82 by means of high pressure and lower pressure signal leads 118 and 120. The high and low pressure signal leads 118, 120 are passed between the first and second electrical cabinets 82, 98 via the second electrical conduit 96. A chart recorder 122 disposed within the second electrical cabinet 98 is coupled to the first and second pressure sensors 110, 112 for graphically recording the upper and lower pressure within distribution line 108. A data module 126 in the first electrical cabinet 82 compares the measured high and low pressures with predetermined high and low pressure limits.

Figure 5:
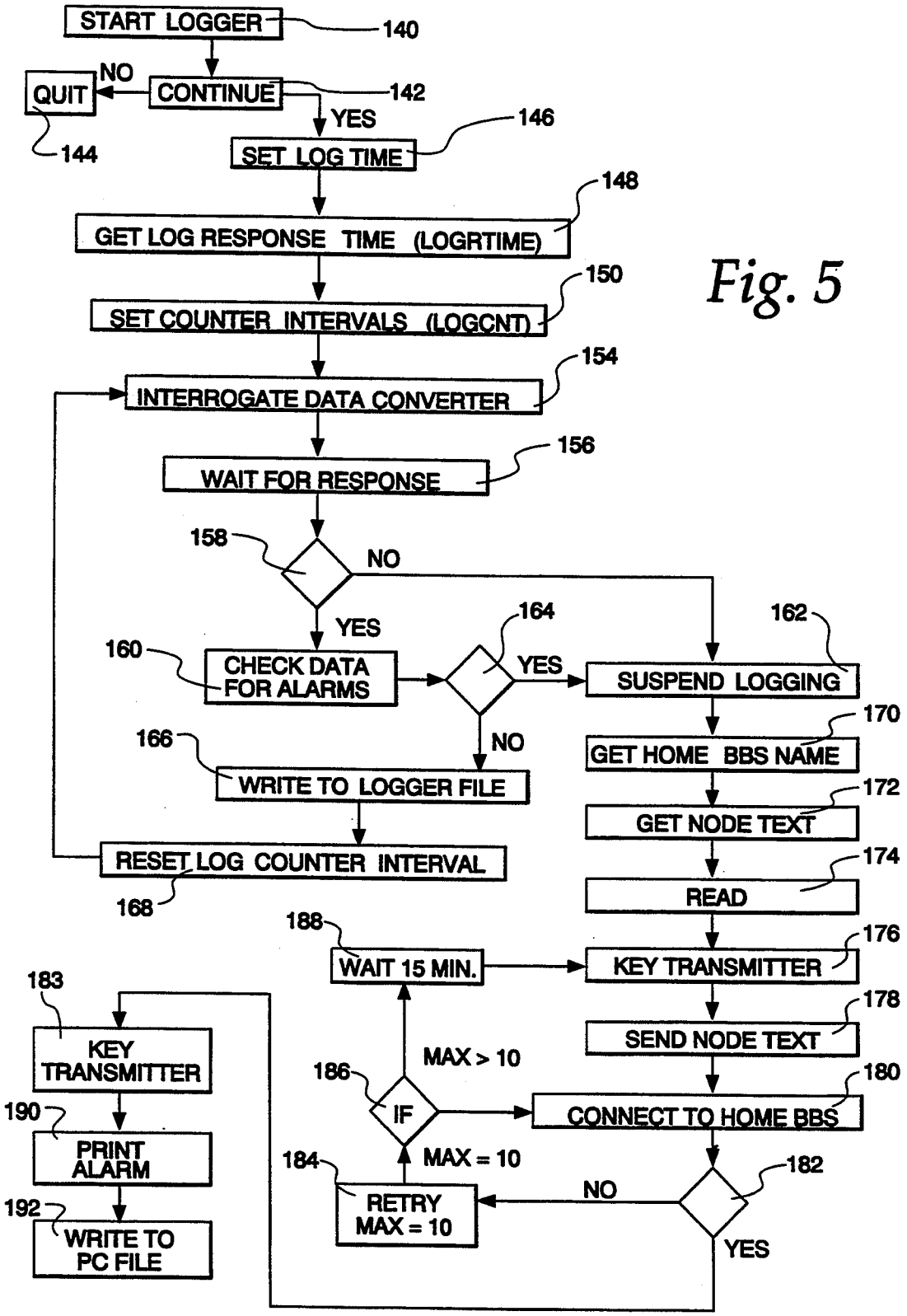
FIG. 5 is a flow chart illustrating details of the operation of each remote logger unit in the remote data collection and monitoring system of the present invention.

Referring to FIG. 5, there is shown a flow chart illustrating details of the operation of each remote logger unit in the remote data collection/monitoring system of the present invention. In FIG. 5, each rectangular block represents the carrying out of an operation by the operating program stored in the remote logger unit's controller, while a diamond shaped symbol represents a decision point in the operating program. Instructions for carrying out the operational sequence shown in FIG. 5 are stored in and provided to the remote logger unit's controller described above. The program stored in the remote logger unit's controller is initiated at step 140 with a start command received from the system's central controller. The program in the remote logger unit's controller then continues to step 142 where a check is performed to determine the number of data modules in the remote logger unit to be checked. If the number at step 142 is determined to be zero, the program branches to step 144 and terminates operation. If at step 142 it is determined that there is at least one data module, or sensor, in the remote logger unit to be checked, the program branches to step 146 and begins setting various system parameters. First, at step 146 the LOGTIME is set, or stored, in the remote logger unit. The LOGTIME is the interval at which the remote logger unit's controller attempts to read data from each remote data module, or sensor. The LOGTIME can be as short as ten seconds or as long as six hours, with the number determined by dividing the number of minutes by ten to obtain the interval number. LOGTIME is represented as a ten-second-per-digit change in time.

At step 148, the log response time (LOGTIME) is set. LOGTIME is the time period that a remote logger unit waits for a response after asking for data from a particular data converter connected to a remote sensor. A typical time period for the LOGRTIME is 100 milliseconds. If no response is received within the LOGRTIME, an alarm is triggered as described below. At step 150, the LOGCNT is set representing the number of voltage inputs, or data inputs, to the RS-232 converters in the remote logger unit for collecting and storing operating data. LOGCNT can be virtually any number, with the maximum number of data converters (and associated remote sensors) used in a preferred embodiment being nine.

After setting the LOGTIME, LOGRTIME and LOGCNT, the remote logger unit operating program proceeds to step 154 and interrogates each data converter in the remote logger unit. At step 156, the operating program attempts to read any data into the logger controller's memory. The program then determines at step 158 if there is any data, and if there is available data, the program proceeds to step 160 to check for the receipt of any alarms. At this step, a software time window comparator checks for a predetermined time period (3 seconds in a preferred embodiment) for a high or low limit alarm. If a high or low limit alarm is received during this time period, the Logger controller outputs a "01", "02" or "03" indicating an alarm. If there are no alarms detected at step 160, the logger controller outputs a 00 and writes this output into the logger file at step 166. The program then proceeds to step 168 for resetting the log counter interval (LOGCNT) and branches back to step 154 for again interrogating the next data converter. In the loop from step 168 in which the LOGCNT is reset and the program returns to the interrogate data converter step 154, the operating program continuously executes a loop waiting for the next interval in which sensor data is received from any of the data converters.

If, at step 158, there is no response received from any of the data converters, the program proceeds to step 162 and suspends the logging operation. Failure to receive a response from any data converter indicates a problem such as a battery failure. The data converters operate down to 9.9V, while the radio and controller operate down to less than 7V. There is thus an approximately 2V window for use in initiating a battery alarm. Similarly, if at step 164 it is determined that an alarm has been received, the program outputs a 01, 02 or 03 and proceeds to step 162 for suspending logging. After logging is suspended at step 162, the program calls the central controller in the bulletin board system (BBS) by name. The program then, at step 172, reads a node text stored in memory for executing a message routing routine for directing operating data from one or more remote logger units via the other logger units to the central controller. This routing operation of messages from the various remote logger units to the central controller is described below. The program, at step 174, then reads the routing instructions in the node text into a transmit buffer and executes a keying of the remote transmitter, at step 176, for transmitting the node text, at step 178, for proper routing of the sensor data back to the system's central controller. At step 180, the remote logger unit attempts to connect to the central controller, or home BBS, and executes as many as ten retries in a loop comprised of steps 182, 184 and 186 if contact with the central controller is not established. Following ten unsuccessful attempts to connect to the central controller, the program, at step 188, then waits for 15 minutes before again keying the remote transmitter, at step 176, in attempting to communicate with the central controller. Following the establishing of communication of the remote logger unit with the central controller as determined at step 182, the program branches to step 183 where the remote transmitter is again keyed for transmitting the operating data to the central controller. At step 190, a print alarm message is provided for printing out the alarm message at a remote printer at the logger unit. At step 192, a write command is sent from the remote logger unit to the central controller for storing the alarm message in the PC file of the central controller.

Figure 6A:
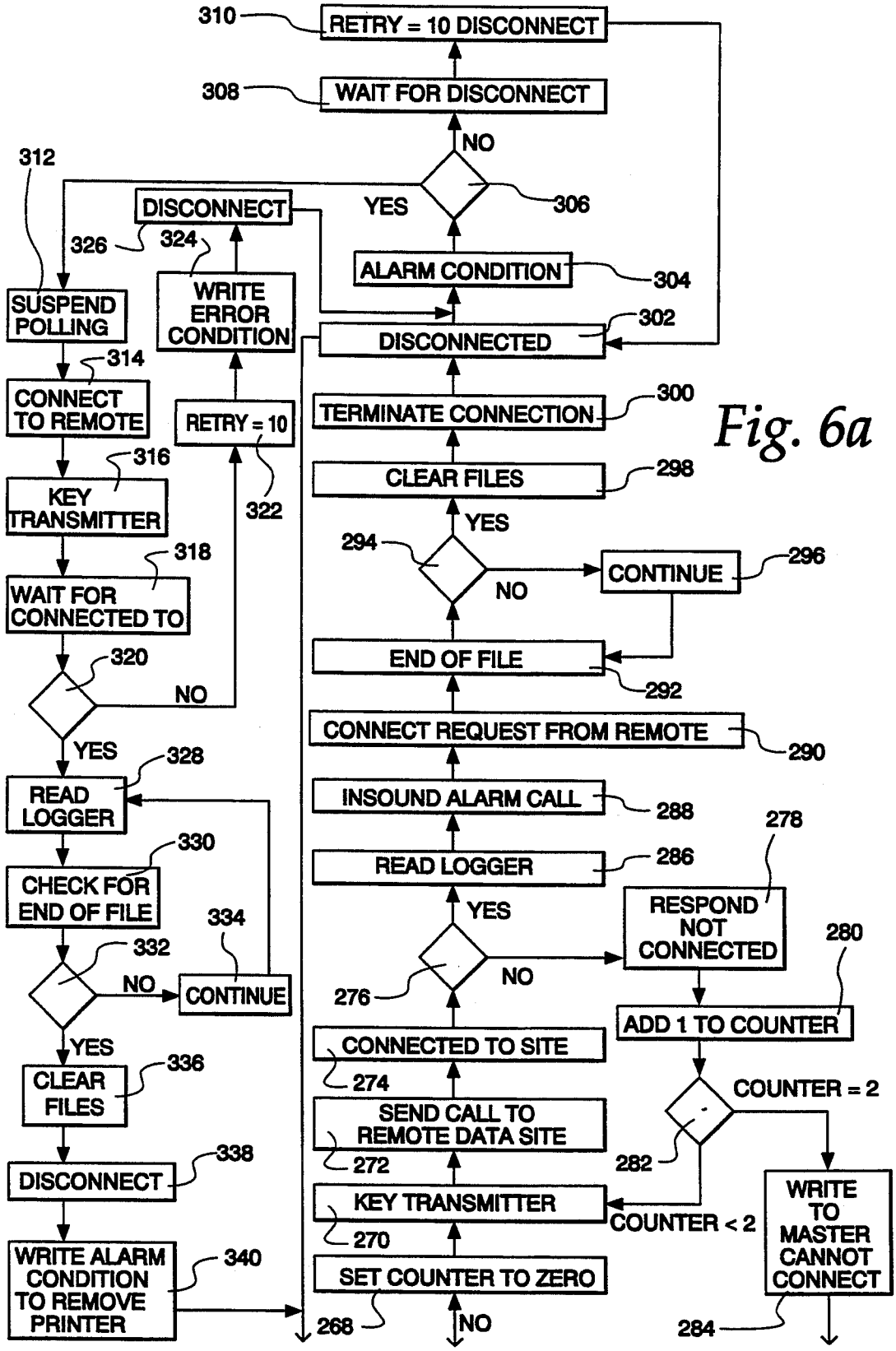
FIGS. 6*a* and 6*b* are flow charts illustrating details of the operation of the central controller in monitoring and controlling each of the remote logger units in accordance with the present invention.
Figure 6B:
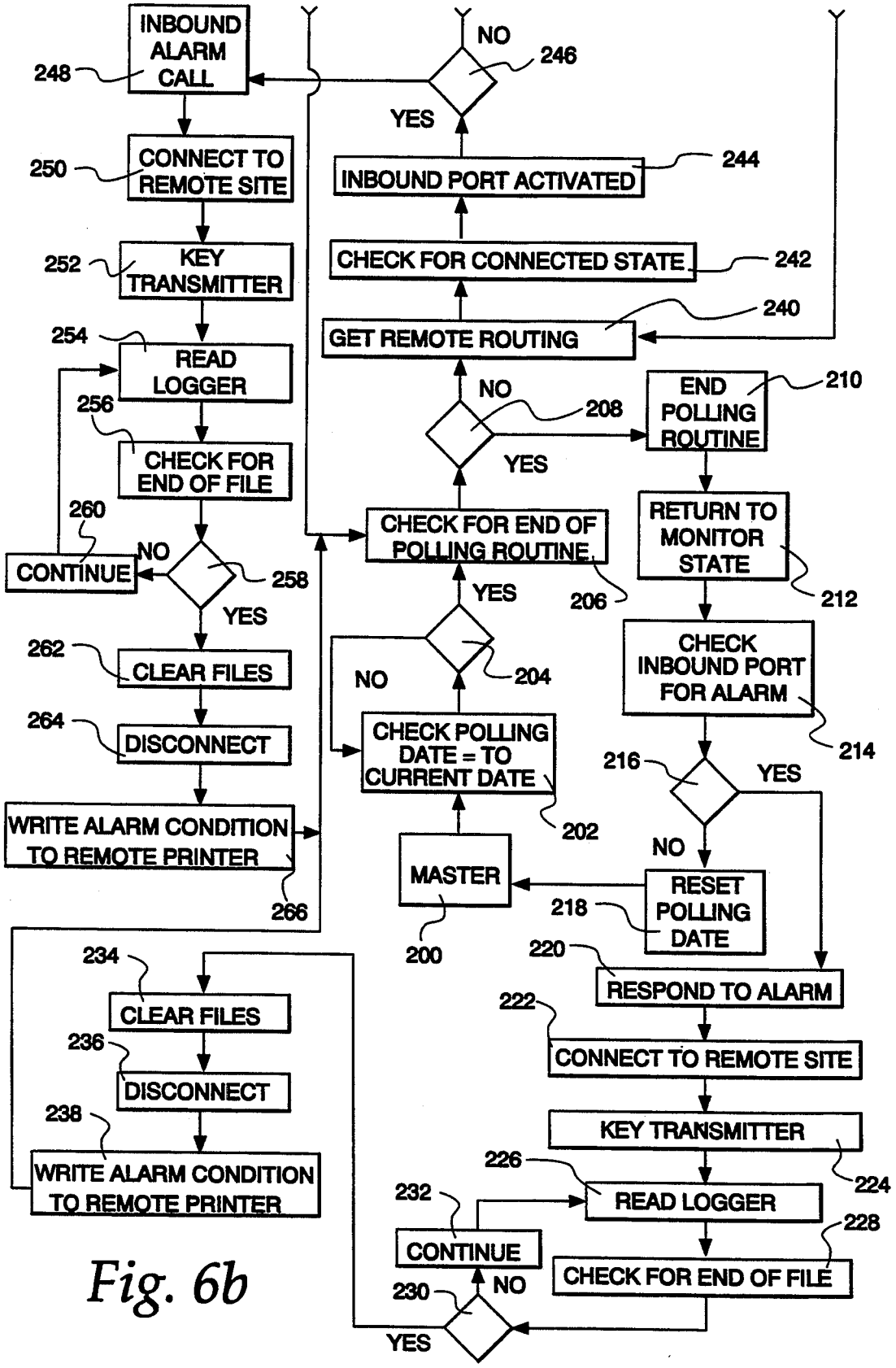

Referring to FIGS. **6*a* and 6*b*, there is shown a flow chart representing the operations carried out by the remote logger units and the central controller in accordance with the present invention. Operation of the central controller is initiated at step 200 in a lower portion of FIG. 6*b* where the central controller, or master, initiates a reading of sensor data from a remote logger unit. The polling date is checked with the current date at step 202. If these two dates do not match as determined at step 204, the program executes a loop until these two dates match. If the polling date corresponds to the current date as determined at step 204, the program proceeds to step 206 and checks for the end of the polling routine. If at step 208 it is determined that the polling routine has been completed, tile program proceeds to the end polling routine at step 210 and begins monitoring the remote logger units at step 212. The inbound port is then checked for the receipt of an alarm at step 214. If at step 216 receipt of an alarm at the inbound port is not determined, the program proceeds to step 218 for resetting the polling date and again initiating the remote logger unit polling routine of the central controller at step 200**.

At step 216, if it is determined that an alarm has been received at the inbound port, the program proceeds to step 220 and prepares to respond to the alarm. The central controller is connected to the remote logger unit at step 222, followed by keying of the central controller's transmitter at step 224. The operating data stored in the remote logger unit is then read by the central controller at step 226, until an end of file indication is received by the central controller at step 228. This subroutine continues at step 232 until an end of file indication is received by the central controller indicating that all of the alarms detected by the remote logger unit have been read into the central controller. Once the end of file has been reached, the program branches to step 234 for clearing the files followed by execution of a disconnect of the central controller from the remote logger unit at step 236. The program at step 238 then causes the alarm indication received by the central controller to be written by the remote printer at step 238. Following printing of the alarm message at step 238, the program then proceeds to step 206 to check for the end of remote logger unit polling routine. When it is determined at step 208 that the end of the remote logger unit polling routine has not yet been reached indicating that all remote units have not yet been polled, the program proceeds to step 240 to determine the routing of the remotely sensed operating data to the central controller. The program next at step 242 determines if any remote logger unit is connected to the central controller. The program then activates the inbound port of the central controller at step 244.

With the inbound port activated, the program branches at step 246 to receive an inbound alarm call at step 248. The central controller is then connected to the remote logger unit at step 250, followed by keying of the remote logger unit's transmitter at step 252. Data is then read from the remote logger unit at step 254, followed by a check for the end of the file at step 256. This routine continues at step 260 in a loop until the entire file of the remote logger unit is read by the central controller, at which time the program branches at step 258 to clear all the files at step 262 in the remote logger unit, followed by disconnecting from the remote logger unit at step 264. The alarm condition is then written to the remote printer at step 266 to alert a system operator. The program then returns to step 206 and again checks for the end of the polling routine. The loop extending from step 248 to step 266 is executed when an alarm is detected while the central controller is in the polling routine for polling each of the remote logger units for system operating data and/or alarms.

Following a check for the end of the polling routine at step 206 and a determination that the polling routine is not yet completed at step 208, the program proceeds as previously described to step 246 for a determination of whether the inbound port has been activated. If the inbound port has not been activated as determined at step 246, the program proceeds to step 268 for setting a retry counter to 0. This allows for two tries in attempting to connect to a remote logger unit. If contact is not established with a remote logger unit after two tries, the system alerts the operator to a problem as described below. After resetting the retry counter to 0 at step 268, the program provides for a keying of the transmitter at the central controller at step 270 in attempting to contact a remote logger unit. A call is then sent to the remote logger unit at step 272 followed by a check for the establishment of a connection between the central controller and the remote logger unit at step 274. If it is determined at step 276 that connection has not been established between the central controller and the remote logger unit, the program branches to step 278 where a response is provided to the central controller indicating that it is not connected to the remote logger unit. At step 280, 1 is added to the retry counter and the connection check is again initiated at step 270 if it is determined at step 282 that less than two attempts to connect to the remote logger unit have been performed. If at step 282 it is determined that two unsuccessful attempts to contact the remote logger unit have been made by the central controller, the program branches to step 284 and alerts the operator that the central controller is unable to connect with the remote logger unit. The program then loops back to step 240 to again attempt to obtain the remote routing information for the recorded operating data or alarm information from the remote logger unit to the central controller.

The program continues in this loop until the central controller is connected to the remote logger unit as determined at step 276, with the program then proceeding to step 286 for reading the operating data or alarm information from the remote logger unit. A check is performed for any inbound alarm calls at step 288, followed by a check for receipt of a connect request from any remote logger unit at step 290. The program next checks to determine if the end of the file has been reached for the remote logger unit connected to the central controller at step 292. If the end of the file for that particular remote logger unit has not yet been reached as determined at step 294, the program executes a continue loop at step 296 until the end of the file for the remote logger unit is reached. The program then clears the files at step 298 followed by a termination of the connection to the remote logger unit at step 300. The central controller and remote logger unit are disconnected at step 302, followed by a check to determine the existence of an alarm condition at step 304. If an alarm condition is detected at step 306, the program branches to step 312 and executes a loop by beginning with the suspension of polling of the remote logger units. The program at step 314 then connects the central controller to the remote logger unit from which the alarm indication was received and keys the transmitter of the central controller at step 316. The program then waits for a connection to the remote logger unit from which the alarm indication was received at step 318. If an indication of the connection of the central controller to the remote logger unit is not detected at step 320, the program branches to step 322 and enters a retry mode and attempts to make the connection. Up to ten attempts may be tried for connecting the central controller to the remote logger unit which emitted the alarm signal. If a connection is not made within ten attempts at step 322, the program proceeds to step 324 and executes a write error condition which is entered in a master alarm report in the PC file and is printed out on the central controller's printer. This error condition gives rise to an automatic disconnect at step 326 followed by another check for an alarm condition at step 304.

If at step 320 a connection of the central controller to the remote logger unit is established, the program branches to step 328 and reads the contents of the remote logger unit, followed by a check for the end of the remote logger unit file at step 330. If the end of the remote logger unit file is not detected at step 332, the program continues at step 334 in a loop until the end of the file is detected. Upon detection of the end of the remote logger unit file at step 332, the program clears the files at step 336, executes a remote logger unit disconnect at step 338 and writes an alarm condition to the remote printer at step 340. The program then branches to step 206 and again executes a check for the end of the polling routine.

If at step 306 a determination is made that an alarm condition does not exist, the program branches to step 308 and waits for a disconnect of the central controller from the remote logger unit. The remote logger unit will try up to ten times to disconnect from the central controller at step 310, followed by a return to step 302 and execution of an automatic disconnect. The program then again checks for the end of the polling routine at step 206.

Figure 7:
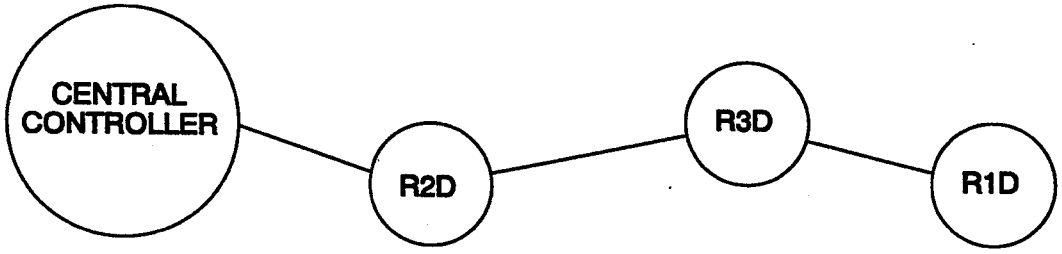
FIG. 7 is a simplified schematic diagram of an example of the routing from one remote logger unit to the central controller via other remote logger units of distribution line operating data and/or alarm information in accordance with one aspect of the present invention.

Referring to FIG. 7, there is shown a simplified schematic diagram of the arrangement of a master, or central, controller and several remote logging units designated as R2D, R3D and R1P. For the purpose of explaining the manner in which the present invention routes master initiated commands in one direction and remote logger unit operating data and alarm signals in a second direction, reference is now made to FIG. 7. If the central controller desires to communicate with the R1P remote logger unit via the R2D and R3D remote logger units, an operator enters the following command in the central controller: CONNECT R1P VIA R2D, R3D. After the word "CONNECT", the call sign of the unit to be communicated with is inserted, followed by the command "VIA". The unit, or units, following "VIA" designate the routing of the instruction from the central controller to the R1P remote logger unit, where the first unit designated is the first unit in the communications path. The routing instructions are stored in the central controller as well as in each of the R2D, R3D and R1P remote logger units. Following the key word "VIA", a list of from one to eight call signs may be inserted for routing of information between the central controller and the various remote logger units. The call signs in the list must be separated by commas or by blank spaces. Similar statements may be entered for specifying the routing of operating data and alarm signals from each of the R2D, R3D and R1P remote logger units to the central controller.

There are three different communications paths through each remote logger unit. One communications path is the primary talk path which provides direct access through a serial port to the remote logger unit. A second path is known as a bulletin board path which is adapted for receiving and logging operating data under file headers so they can be stored in memory and then later, barring any alarms, downloaded to the central controller. A third communications path renders the remote logger unit essentially transparent to the transmitted data, allowing the data to be re-transmitted through the remote logger unit to the intended receiver of the data. The first path allows programming changes in the remote logger units to be made without communicating through the bulletin board path. The bulletin board communications path allows for programming of the various system operating parameters such as LOGTIME, LOGRTIME and LOGCNT. The third, repeating communications path is basically transparent to the other two paths and permits the remote logger unit to be used as a stepping stone between the central controller and one or more remote logger units without interrupting operation of the logger unit through which the data is transmitted.

There has thus been shown a remote data collection and monitoring system for a distribution line, or a transmission system, wherein a central controller is coupled to a plurality of remote logger units, each adapted for monitoring various operating parameters of the distribution line. Each remote logger unit is coupled to other remote logger units as well as to the central controller via an RF link and is programmed from the central controller to monitor a given number of remote sensors, to read operating data from each of the remote sensors at a predetermined time interval, and to wait a specified amount of time for a response from a remote sensor after the remote sensor is asked for operating data. Each remote logger unit is also capable of determining an alarm situation when one or more operating parameter signals exceed specified limits for alerting the central controller of an alarm condition. The remote logger units communicate either directly to the central controller or via other remote logger units in a designated routing arrangement for either receiving commands from the central controller or providing distribution line operating data or alarm signals to the central controller. Each remote logger unit is passive in operation, autonomous and entirely independent of the central controller and may be battery operated using a solar charging arrangement. The operating data reported by the remote logger unit to the central controller includes the identity of the logger unit, the nature of the data or alarm, and the time and date of the report.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. Apparatus for monitoring a distribution line such as for gas, water or oil at a plurality of remote locations and providing status and alarm information for said distribution line, said apparatus comprising:

a plurality of remote logger units each located at a respective remote site and including a plurality of sensors coupled to the distribution line for providing status signals representing operating parameters of the distribution line, wherein each of said logger units includes:

alarm means for comparing each of said status signals with predetermined upper and/or lower limits associated with a respective operating parameter of the distribution line and for providing an alarm signal when a given status signal exceeds an upper or lower limit associated with said respective operating parameter;

RF transmitter/receiver means for providing RF signals representing said status and alarm signals and for receiving RF signals from another of said logger units; and control means coupled to said RF transmitter means for transmitting an RF signal representing said status signals at predetermined time intervals and for transmitting an RF signal representing said alarm signal when said alarm signal occurs;

a central controller responsive to said transmitted RF signals for recording and displaying said status and alarm signals; and message routing means in each of said remote logger units for directing said RF signals from a first remote logger unit to said central controller via one or more second remote logger units.

2. The apparatus of claim 1 wherein said first remote logger unit is more distant than said one or more second remote logger units from said central controller.

3. The apparatus of claim 1 wherein said message routing means includes means for directing said RF signals through predetermined ones of said one or more second remote logger units to said central controller from said first remote logger unit.

4. The apparatus of claim 1 wherein each remote logger unit includes solar energy converting means for powering each of said remote logger units.

5. The apparatus of claim 4 wherein each remote logger unit further includes a storage battery coupled to said solar energy converting means for storing energy and for powering its associated remote logger unit when solar energy is low.

6. The apparatus of claim 1 wherein said alarm signal includes information describing the nature and source of the alarm.

7. The apparatus of claim 1 wherein said RF signals include the time and date of the occurrence of associated status and alarm signals.

8. The apparatus of claim 7 wherein said central controller includes a printer for providing a printout of said RF signals representing said status and alarm signals.

9. The apparatus of claim 1 wherein said control means includes means for accessing each of said sensors in a predetermined, timed manner for providing said status and alarm signals.

10. The apparatus of claim 9 wherein said control means further includes timing means for providing an alarm signal to said central controller if a status or alarm signal is not received within a predetermined time period after a sensor is accessed.

11. A method for monitoring a distribution line such as for gas, water or oil at a central controller, said method comprising the steps of:

detecting operating parameters of the distribution line at one of a plurality of remote sites in the distribution line and providing a plurality of status signals each representing a respective operating parameter of the distribution line;

comparing each status signal with a respective high and/or low operating parameter limit and providing an alarm signal when a status signal exceeds its associated high or low operating parameter limit; and transmitting an RF signal representing said status signals at predetermined time intervals or representing said alarm signal when said alarm signal occurs from said one of said remote sites to the central controller wherein the step of transmitting an RF signal from one of said remote sites to said central controller includes routing of said RF signal from said one remote site via other ones of said remote sites to said central controller.

12. The method of claim 11 wherein said other ones of said remote sites are disposed intermediate said one remote site and said central controller.

13. The method of claim 11 wherein said status and alarm signals include an identity of said one remote site and the time, date and nature of said operating parameters and the operating parameter limit exceeded, respectively.

* * * * *

UNITED STATES PATENT AND TRADEMARK OFFICE

CERTIFICATE OF CORRECTION

PATENT NO. : 5,381,136

DATED : January 10, 1995

INVENTOR(S) : Robert D. Powers and Harold L. Ryterski

It is certified that error appears in the above-identified patent and that said Letters Patent is hereby corrected as shown below:

In Col. 8, line 52, "tile" should be --the--.

In Claim 11, Col. 14, line 22, after "from", insert --said--.

Signed and Sealed this

Twenty-third Day of May, 1995

*Attest:*

Bruce Lehman

BRUCE LEHMAN

*Attesting Officer*

*Commissioner of Patents and Trademarks*